US009463350B2

(12) United States Patent
Snyderman

(10) Patent No.: US 9,463,350 B2
(45) Date of Patent: Oct. 11, 2016

(54) EXERCISE DEVICE

(71) Applicant: Leonard Snyderman, Cohasset, MA (US)

(72) Inventor: Leonard Snyderman, Cohasset, MA (US)

(73) Assignee: M & S Distribution, Inc., Boston, MA (US)

( * ) Notice: Subject to any disclaimer, the term of this patent is extended or adjusted under 35 U.S.C. 154(b) by 0 days.

(21) Appl. No.: 14/263,252

(22) Filed: Apr. 28, 2014

(65) Prior Publication Data

US 2014/0357454 A1 Dec. 4, 2014

Related U.S. Application Data

(60) Provisional application No. 61/854,751, filed on May 1, 2013.

(51) Int. Cl.

| | |
|---|---|
| ***A63B 21/22*** | (2006.01) |
| ***A63B 22/06*** | (2006.01) |
| ***A63B 71/06*** | (2006.01) |

(52) U.S. Cl.

CPC ..... *A63B 22/0605* (2013.01); *A63B 21/227* (2013.01); *A63B 22/0694* (2013.01); *A63B 71/0619* (2013.01); *A63B 2022/0611* (2013.01); *A63B 2022/0623* (2013.01); *A63B 2022/0647* (2013.01); *A63B 2220/17* (2013.01)

(58) Field of Classification Search

CPC ..... A63B 22/0605–2022/0611; A63B 2022/0647; A63B 22/08; A63B 22/0694; A63B 22/0056–22/0058; A63B 22/06–2022/0658

See application file for complete search history.

(56) References Cited

U.S. PATENT DOCUMENTS

| | | | | |
|---|---|---|---|---|
| 2,081,365 | A | 5/1937 | Mueller | |
| 4,396,189 | A | 8/1983 | Jenkins | |
| 4,643,419 | A | 2/1987 | Hyde | |
| 4,786,050 | A | 11/1988 | Geschwender | |
| 5,267,922 | A | 12/1993 | Robinson | |
| 5,403,255 | A | 4/1995 | Johnston | |
| 5,536,225 | A | 7/1996 | Neuberg et al. | |
| 5,569,127 | A | 10/1996 | Johnston | |
| 5,595,554 | A * | 1/1997 | Maresh | A63B 21/157 482/52 |
| 5,830,111 | A | 11/1998 | Johnston | |
| 5,902,216 | A | 5/1999 | Lee | |
| 6,679,813 | B1 | 1/2004 | Gray | |
| 7,108,638 | B2 | 9/2006 | Snyderman | |
| 7,150,332 | B2 | 12/2006 | Edmonds, Jr. | |
| 7,682,293 | B2 | 3/2010 | Eschenbach | |
| 2005/0277517 | A1* | 12/2005 | Snyderman | A63B 22/0605 482/52 |
| 2008/0161168 | A1* | 7/2008 | Hsiao | A63B 21/0053 482/63 |
| 2008/0214362 | A1* | 9/2008 | Eschenbach | A63B 21/015 482/52 |

OTHER PUBLICATIONS

International Search Report for PCT/US2014/035800, 2 pp, dated Sep. 23, 2014 by ISA/US.
Written Opinion of the International Searching Authority for PCT/US2014/035800, 4 pp, dated Sep. 23, 2014 by ISA/US.
International Preliminary Report on Patentability for PCT/US2014/035800, 5 pp, dated Nov. 3, 2014 by the International Bureau of WIPO.

* cited by examiner

*Primary Examiner* — Oren Ginsberg
*Assistant Examiner* — Jennifer M Deichl
(74) *Attorney, Agent, or Firm* — Sack IP Law P.C.; Alan M. Sack; Kimberley Elcess

(57) ABSTRACT

An improved structure for an exercise device having dual pedals wherein each pedal operates in a rotary manner in a vertical plane parallel to the bilateral axis of the user with each of the user's feet disposed, respectively, on a different one of the dual pedals.

7 Claims, 4 Drawing Sheets

EXERCISE DEVICE

CROSS REFERENCE TO RELATED APPLICATIONS

This application is based on Provisional Application Ser. No. 61/854,751 filed May 1, 2013, which is hereby incorporated by reference.

BACKGROUND OF THE INVENTION

1. Field of the Invention

The invention resides in the field of exercise equipment and more particularly relates to bicycle style pedal or crank leg motivated devices.

2. Description of the Prior Art

This disclosure relates to a foot pedal operated exercise machine wherein two side-by-side pedal units are arranged to rotate in a vertical plane parallel to a vertical plane through the users bilateral axis. A suitable structure for, and the operation of, such a device are fully illustrated in U.S. Pat. No. 7,108,638 by the same inventor which is hereby incorporated by reference.

As disclosed in that patent, a pulley and belt arrangement combination provides counter-rotating movement of two crank arms. The pulleys are fixed to an axle or shaft at one end and a crank arm at the opposite end. A pedal is attached to the crank arm that the user stands on to create circular motion. The crank arm and pulley are both affixed to a shaft that rotates on bearings in a tube secured to a frame. There is one of these assemblies positioned on the left and one on the right of the frame, one for each foot. The crank arm is on the front side of the tube and frame and the pulley is on the backside. This mechanical system creates counter rotation of the two crank arms by the arrangement and operation of the component parts as further described in that patent.

An improved and alternative structure which functions to provide a pedal motivated exercise device for side-by-side rotation, as opposed to the better known back to front bicycle style machines, is presented below.

SUMMARY OF THE INVENTION

The invention described herein utilizes a fixed instead of a moving axel or shaft. In this arrangement, a sprocket gear and crank arm rotate on an axel instead of being fixed to a shaft and rotating the entire combination inside of a bearing or tube. In this new improved design, the crank arm and sprocket gear are directly attached to one another rather than being separated by a moving shaft. Counter rotation between one side and the other is created by, for example, the use of two idler gears connected by roller chains, or by the direct meshing of the right and left sprocket gears.

The advantages and features of the invention will be further understood from the description of the preferred embodiment and drawings which follow.

DESCRIPTION OF THE PREFERRED EMBODIMENT

Figure 1:
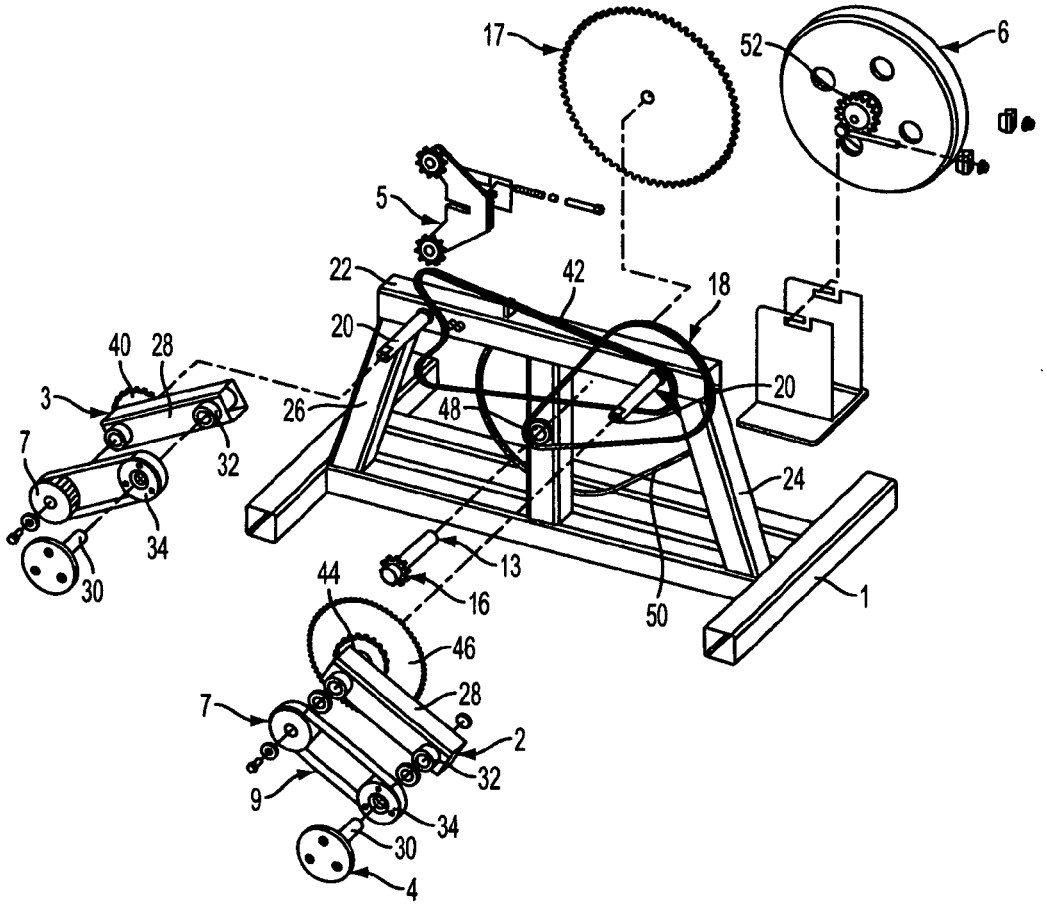
FIG. 1 is a perspective view illustrating a preferred embodiment of the invention in exploded format.
Figure 2:
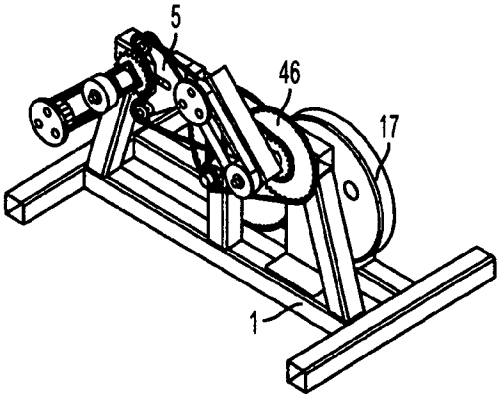
FIG. 2 is an assembled perspective view of the preferred embodiment of FIG. 1.
Figure 6:
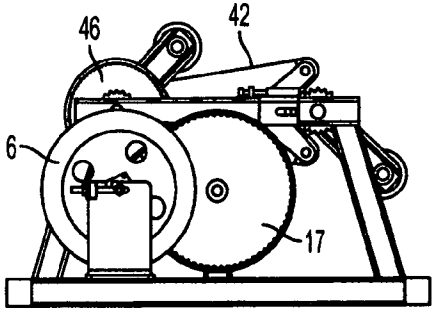
FIG. 6 is a rear view of the preferred embodiment of FIG. 2.
Figure 5:
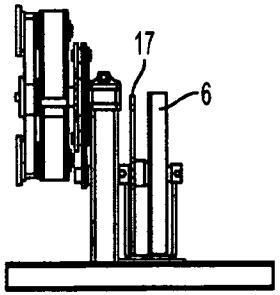
FIG. 5 is a side view of the preferred embodiment of FIG. 2.
Figure 3:
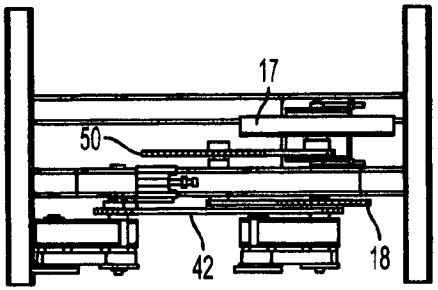
FIG. 3 is a top view of the preferred embodiment of FIG. 2.
Figure 4:
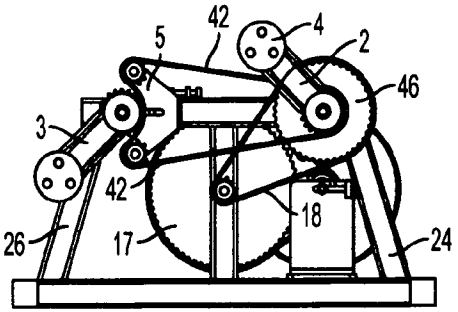
FIG. 4 is a front view of the preferred embodiment of FIG. 2.
Figure 7:
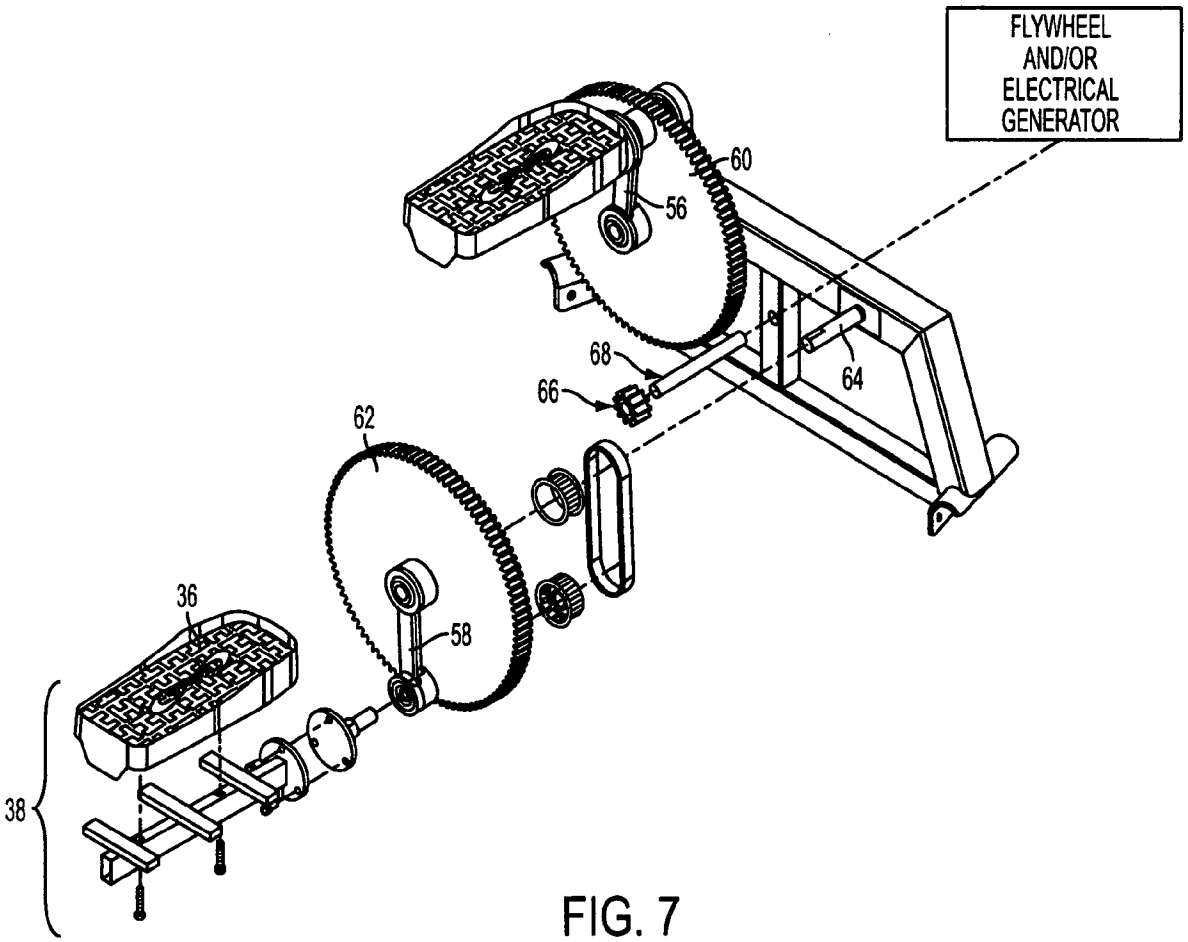
FIG. 7 is a perspective view illustrating an additional preferred embodiment of the invention in exploded format.

Referring to FIG. 1, there is shown in perspective assembly format a first example of the parts of the invention in which frame 1 provides the support base for the rotating and synchronizing components of the machine. Right and left pedal crank assemblies 2 and 3 are each rotatably mounted on axels 20 extending from frame crossbar 22 and supported by diagonal uprights 24 and 26. Each assembly consists of a rotatable pedal support member 28 having, at the opposite end of the axel mount, a pedal mount 4 having axel 30 which is rotatably mounted in hub 32. Pedal mount 4 is attached to a timing belt sprocket 34 which rotates on pedal mount axel 30. At the opposite end of support member 28, a second timing belt sprocket 7 is attached to axel 20. Timing belt sprockets 7 and 34 are linked by timing belt 9. FIG. 7 illustrates a suitable pedal 38 attachable to pedal mount 4.

As both the right and left pedal crank assemblies 2 and 3 rotate about axels 20, timing belts 9 will also rotate resulting in the rotation of timing belt sprockets 34 (one turn per the revolution of each crank) which will in turn result in the upper surface 36 of the pedal 38 always remaining in a horizontal plane.

Figure 8:
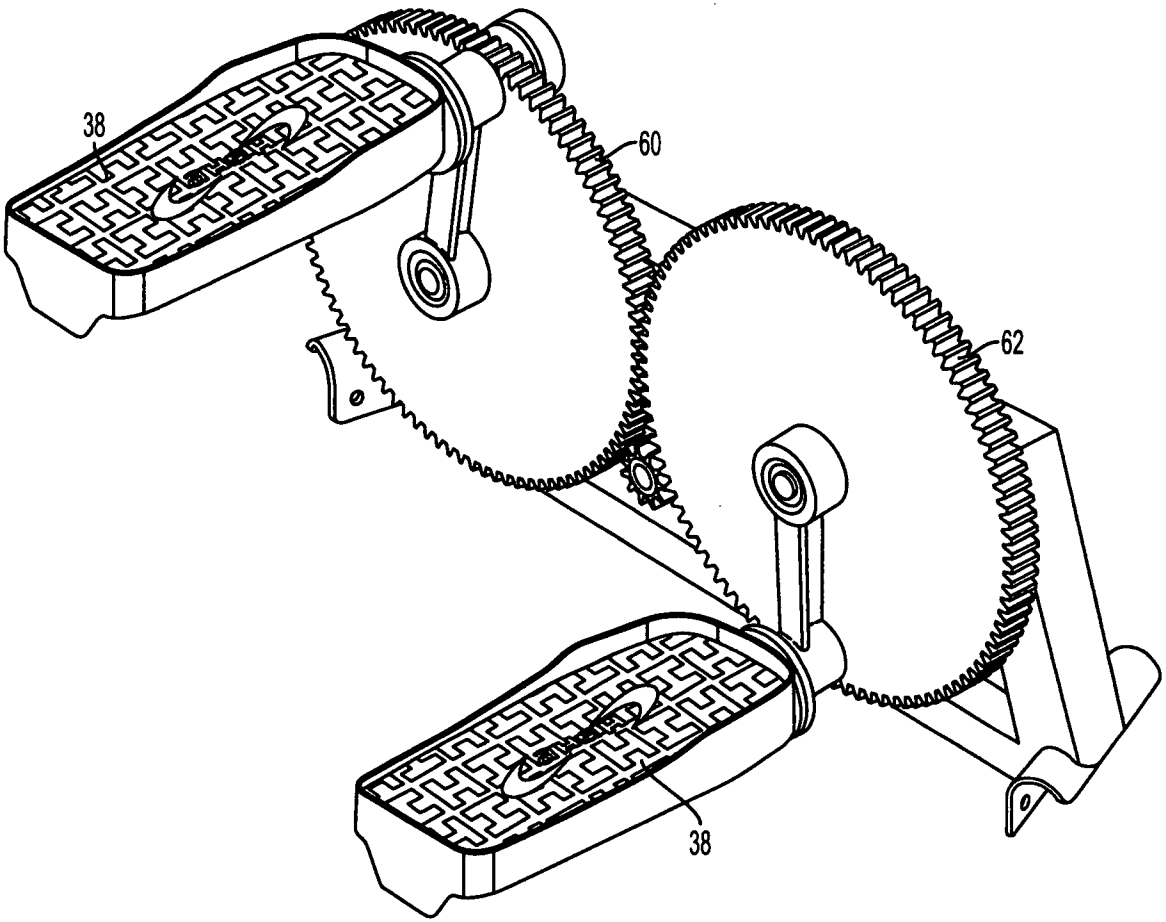
FIG. 8 is an assembled perspective view of the preferred embodiment of FIG. 7.

The pedal assemblies are linked together so as to provide coordinated motion of the users legs when operating the machine. Two examples of such linkage arrangements are illustrated herein. The first is shown in FIG. 1 and the additional views of the same structure in FIGS. 2-6 illustrating perspective, front, back, top, and side views of the entire machine; and the second as depicted in FIGS. 7 and 8.

Referring again to FIG. 1, left pedal crank assembly 3 is coaxially connected to sprocket gear 40 and upon rotation simultaneously turns gear 40 which is engaged with roller chain 42 which in turn engages sprocket 44 similarly connected to the right pedal crank assembly 2. Each combination sprocket gear and crank assembly, i.e., crank 3 and gear 40 and crank 4 and gear 44 thereby function and rotate together as synchronized units.

Chain tensioner 5 provides an automatic adjustment for variations in the slack in chain 42. This combination establishes the synchronization of the left and right pedal cranks Additionally, sprocket 46 is coaxially mounted with and fixed to sprocket gear 44 and functions to drive roller chain 18, which in turn rotates sprocket 16 mounted on frame 1 by shaft 13. Sprocket 48 is coaxially mounted with and fixed to sprocket gear 17 which engages and drives roller chain 50.

Chain 50 engages sprocket 52 and in turn drives generator/flywheel 6 providing power for electrical displays and calculations of operational parameters as well as enhancing the smooth running of the machine.

FIGS. 7 and 8 show a second structure for providing the linkage and auxiliary functions described above. In this approach, the pedal crank assemblies 56 and 58 are mounted directly on synchronizing gears 60 and 62, which mesh thereby turning together to provide the linking function.

These gears and their associated pedal crank assemblies are mounted on and directly rotate about axles 64. The timing belt arrangement for pedal orientation operates in the same manner as that previously shown.

Idler gear 66 is fixed to idler shaft 68 and engages with and is rotated by meshed gears 60 and 62. The consequent rotation of shaft 9 may be arranged to operate a generator and or flywheel, shown schematically, or any other appropriate device similar to the configuration illustrated in FIG. 1.

The invention is accordingly defined by the following claims.

What is claimed is:

1. An exercise device configured to be operated by a user, said user having a dorsal-ventral axis plane, a bilateral axis plane disposed at 90 degrees to said dorsal-ventral axis plane, and first and second legs, each leg having a foot, said device comprising in combination:

A. a frame;

B. first and second axles each comprising a shaft member mounted in a non-rotatable fixed position on said frame in spaced apart substantially parallel relationship;

C. first and second pedal crank assemblies each comprising:

1. a pedal support member having a first and second end, said first end rotatably mounted on one of said axles, and 2. a foot-supporting pedal member having an upper and lower surface rotatably mounted on said second end of said pedal support member; and D. first and second sprocket gears each rotatably mounted on one of said axles, one of each of said sprocket gears secured and attached to one of said pedal support members and coaxially aligned with said first end of one of said pedal support members, said sprocket gears linked together to provide coordinated motion of the user's legs when operating the machine, said first and second pedal crank assemblies and said first and second sprocket gears for rotating, 360 degrees respectively, around said axles, during exercise use defining planes of rotation of said first and second pedal members in a circular pattern; and said planes of rotation of each of said first and second pedal members being parallel to one another, said planes of rotation being in the same vertical plane, said vertical plane being parallel to said bilateral axis plane of said user, said first and second pedal members each adapted for receiving one of said user's feet when said user is positioned on said device such that said user's bilateral axis plane is parallel to said vertical plane of rotation of said first and second pedal members.

2. The exercise device of claim 1 further including a timing belt for maintaining said upper surfaces of said pedal members in an upward-facing horizontal position, upon rotation of said pedal member, throughout all positions of rotation.

3. The exercise device of claim 1 wherein said sprocket gears are linked together by direct meshing.

4. The exercise device of claim 1 wherein said sprocket gears are linked together by at least one roller chain.

5. The exercise device of claim 1 further including an electrical generator operatively connected to at least one of said sprocket gears.

6. The exercise device of claim 1 further including a flywheel operatively connected to at least one of said sprocket gears.

7. The exercise device of claim 1 wherein each of said sprocket gears has front and back surfaces and at least one of said pedal support members is attached directly to at least one of said surfaces of one of said gears.

* * * * *